US006963164B2

(12) United States Patent
Chow et al.

(10) Patent No.: US 6,963,164 B2
(45) Date of Patent: Nov. 8, 2005

(54) COLD CATHODE FLUORESCENT LAMPS

(75) Inventors: Lap Lee Chow, Tsuen Wan (HK); Lap Hang Chow, Tsuen Wan (HK)

(73) Assignee: Colour Star Limited, Hong Kong (HK)

( * ) Notice: Subject to any disclaimer, the term of this patent is extended or adjusted under 35 U.S.C. 154(b) by 132 days.

(21) Appl. No.: 10/662,910

(22) Filed: Sep. 15, 2003

(65) Prior Publication Data

US 2005/0057143 A1 Mar. 17, 2005

(51) Int. Cl.[7] ..... H01J 29/80

(52) U.S. Cl. ..... 313/402; 313/405; 313/491; 313/613

(58) Field of Search ..... 313/402, 405, 313/491, 112, 169, 613, 616, 631

(56) References Cited

U.S. PATENT DOCUMENTS

| | | | | |
|---|---|---|---|---|
| 3,778,662 | A | * 12/1973 | Johnson | 313/490 |
| 4,461,970 | A | 7/1984 | Anderson | 313/240 |
| 4,553,215 | A | 11/1985 | Masuda et al. | |
| 6,337,543 | B1 | 1/2002 | Ge | 315/227 |
| 2002/0140353 | A1 | 10/2002 | Yamashita et al. | 313/634 |

FOREIGN PATENT DOCUMENTS

| | | |
|---|---|---|
| GB | 557516 | 2/1942 |
| GB | 590048 | 4/1945 |
| JP | 8321279 | 12/1996 |
| JP | 11154489 | 6/1999 |
| JP | 2001015063 | 1/2001 |
| JP | 2001118497 | 4/2001 |
| JP | 2001351572 | 12/2001 |
| JP | 2002175776 | 6/2002 |
| WO | WO 99/66407 | 12/1999 |

* cited by examiner

*Primary Examiner*—Vip Patel
(74) *Attorney, Agent, or Firm*—Ostrolenk, Faber, Gerb & Soffen, LLP

(57) ABSTRACT

A cold-cathode fluorescent lamp, comprising a sealed lighting enclosure provided with a phosphor coating on at least part of an inner surface thereof the lighting enclosure. An electrode is provided juxtaposed a region of the inner surface of the lighting tube, the electrode energisable from an external source of energy via an electric lead supporting the electrode, and positioned adjacent the main ionisation region within the lighting enclosure. The phosphor is to be excited by radiation to be generated inside the lighting tube by electric discharge from the electrode to provide visible radiation. At least part of the surface(s) of that portion of the electrode proximal most to the ionisation region are overlaid by a cap made from a high heat resistive and non conductive material.

20 Claims, 5 Drawing Sheets

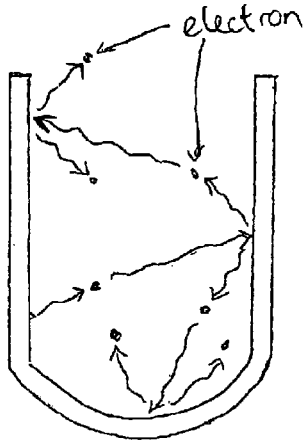
Figure 5
(prior Art)
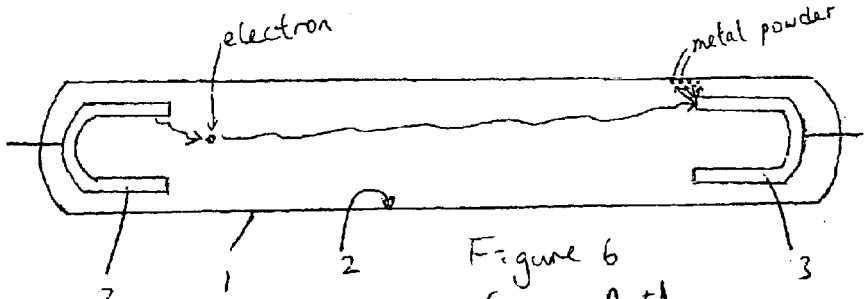
Figure 6
(prior Art)
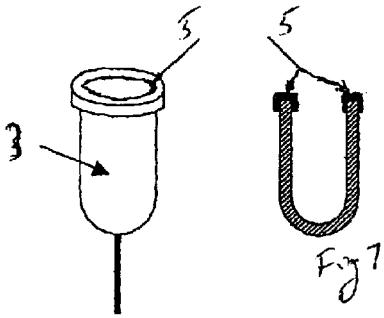
Fig 7b
Figure 7a
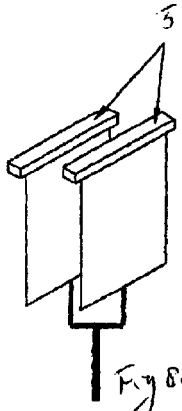
Fig 8A
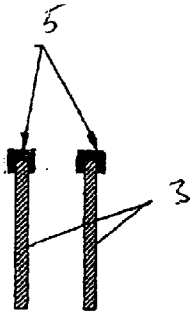
Fig 8B

COLD CATHODE FLUORESCENT LAMPS

FIELD OF THE INVENTION

The present invention relates to improvements to cold cathode fluorescent lamps.

BACKGROUND TO THE INVENTION

Cold Cathode Fluorescent Lamps (CCFL) generally comprise a tube containing an inert gas or a mixture of inert gases and a small quantity of mercury. A pair of complementary electrodes are sealed at opposite ends of the tube in order to supply electrical current through the tube, and a small quantity of an electron emissive material is coated on the surface of the electrodes in order to promote the emission of electrons. When a sufficiently high voltage is applied across the lamps, by means of the electrodes, the electric field established causes some of the electrons within the inert gas and mercury vapour to become accelerated in the direction of the electrodes. Some of the electrons and ions thereby created reach the electrodes with sufficient kinetic energy to cause the electrodes to become heated to emit more electrons partially by the mechanism of field emission and partially by thermionic emission. As the process continues and more and more electrons become created within the lamp volume the electrodes become heated to a point where the electron emission process from the cathode is mainly thermionic and the amount of energy required to sustain the electric discharge created through the lamp becomes substantially reduced i.e. the gas/vapour has become ionised. The ultra violet light generated by the discharge in the ionised gas/vapour in turn excites the phosphorous coating on the tube to emit white/visible light The electrodes generally used within cold cathode devices, for example, neon sign lamps, gas lasers and fluorescent lamps generally comprise a metallic cup-shaped or tube-shaped container and the emissive coating usually consists of a thin coating on the inner surface of the cup or tube.

During the lamp starting process the so-called "glow to arc" transition occurs, where the discharge initially goes from a condition of high localized fields in the vicinity of the electrodes until the electrodes become heated to thermionic emission and to a condition of relatively low energy localized fields in the vicinity of the electrodes when the lamp is in its operational arc discharge mode. During the condition of high localized fields in the vicinity of the cathode the entire electrode structure including the coating is continuously bombarded by relatively energetic electrons and ions until the thermionic emission process occurs. During this period of bombardment a quantity of the emissive coating becomes sputtered away and by this mechanism upon successive starting and "glow to arc" transitions the emissive coating becomes consumed until after a successive number of starts there is no longer sufficient emissive coating to supply electrons to the discharge so that the electrode becomes "deactivated" and the lamp is no longer operational.

CCFL's of a kind as for example shown in FIG. 1 are commonly used for providing back light in scanners, photocopiers and fax machines, and more importantly and recently in LCD monitors/televisions. An important sought-after characteristic of an LCD monitor/television is its lifetime, which depends largely on the lifetime of the CCFL used therein. Many factors can reduce the CCFL's lifetime. For example reduction in the amount of mercury in the tube, changes to the fluorescent powder, deterioration of the glass tube, increases in the amount of waste gases in the tube and the general "aging" of the electrodes.

One problem with the current CCFL is that sputtering occurs when the electrons bombard a small surface area at the end of the electrode (cathode) farthest into the tube (FIG. 6). The electrodes of a CCFL commonly used are mostly tube-shaped (FIG. 1 and FIG. 2). The internal diameter of the glass tube is approximately from 1 to 8 mm, so the diameter of the electrode is approximately from 0.7 to 7 mm.

Two parallel metal plates are also commonly used as an electrode (FIG. 3). A third possibility is a rod-shaped electrode (FIG. 4).

For both the tube-shaped and the parallel plate electrodes, multiple electron emission is possible (see FIG. 5). One result of sputtering is that it causes metal to be collected on the fluorescent powder or the inner wall of the glass tube.

Sputtering will reduce the brightness of the lamp because of the metal "coating" on the wall. The metal collected on the wall will also present a secondary conducting path for the electrons (see FIG. 11). The secondary conducting path may cause emission of waste gases from the glass and eventual breakage of the glass tube.

BRIEF DESCRIPTION OF THE INVENTION

It is therefore an object of the present invention to improve the lifetime of a CCFL by reducing and/or eliminating sputtering or to at least provide the public with a useful choice.

Accordingly in a first aspect the present invention consists in a cold-cathode fluorescent lamp, comprising:

a sealed lighting tube including an ionisable gas or vapour at least one electrode provided at an end of said tube, a coating on at least part of an inner surface of said tube wherein ionisation of said gas or vapour on energisation of said electrode causes said coating to provide visible radiation, and at least one electron or ion shield fitted to and covering at least a sputtering vulnerable portion of the tip of said electrode and capable of withstanding the operating temperature of said electrode.

Preferably said shield comprises a cap provided over at least part of at least those surface(s) of said electrode facing the other end of said tube, and wherein said cap is made from a high heat resistant and electrically insulating material Preferably the lighting tube is of an outside diameter of less than 12 mm.

Preferably said shield is made of a material selected from any one of enamel, ceramic and quartz.

Preferably where the electrode is tube shaped and said shield is annular ring shaped with an inside diameter slightly smaller than the inside diameter of said tubular cylindrical electrode and an outside diameter slightly larger than the outside diameter of said cylindrical electrode.

Preferably where the electrode is rod shaped, said shield is disk shaped with an outside diameter slightly larger than the outside diameter of said cylindrical electrode.

Preferably where the electrode is rod shaped, said shield is annular ring shaped with an outside diameter slightly larger than the outside diameter of said cylindrical electrode and with a central opening there through.

Preferably two of said electrodes are provided, one at each end of said lighting tube.

Preferably said electrode is provided within said lighting tube rather than at the end.

Preferably said shield comprises a cap provided over at least part of the surface(s) of that portion of said electrode proximal most to the ionization region within said lighting tube and wherein said cap is made from a high heat resistant and electrically insulating material.

Preferably said at least part of the surface(s) of that portion of the electrode are those surface which are portions of low heat transfer.

Preferably said at least part of the surface(s) of that portion of the electrode are those surface which are facing the ionisation region.

In a second aspect the present invention consists in an electron shield for an electrode for a cold-cathode fluorescent lamp as described above wherein said shield being of a kind to engage the tip of said electrode and capable of being positioned over at least part of at least those surface(s) of said electrode facing the other end of said tube.

In a third aspect the present invention consists in a method of reducing sputter within a cold-cathode fluorescent lamp as described above the method comprising engaging said shield to the tip of said electrode in a manner to at least part cover at least those surface(s) of said tip of said electrode facing the other end of said tube.

In a fourth aspect the present invention consists in a method of reducing sputter in a cold-cathode fluorescent lamp as described above wherein said electrode provided juxtaposed a region of said inner surface of the lighting tube the method comprising the positioning of said shield over at least part of the surface(s) of that portion of said electrode proximal most to the ionisation region within said lighting tube.

In a fifth aspect the present invention consists in a cold-cathode fluorescent lamp as described above wherein said electrode comprising a pair of plate shaped electrodes provided at an end region of the lighting tube, each electrode positioned juxtaposed and with the planes of their plates parallel to each other wherein each said electrode of said pair includes a shield provided over at least part of at least those surface(s) of said electrode facing the other end of said tube.

In a sixth aspect the present invention consists in a cold-cathode fluorescent lamp as described above wherein said electrode comprising a pair of plate shaped electrodes provided within the lighting tube, each electrode positioned juxtaposed and with the planes of their plates parallel to each other and each positioned adjacent the ionisation region within said lighting enclosure wherein at least part of the surface(s) of that portion of each said electrode proximal most to said ionisation region are overlaid by said shield.

In a seventh aspect the present invention consists in an electron shield for an electrode for a cold-cathode fluorescent lamp as described above wherein said electrode comprising a pair of plate shaped electrodes provided at an end region of the lighting tube, each electrode positioned juxtaposed and with the planes of their plates parallel to each and wherein the planes are parallel to the elongate axis of said lighting tube, wherein each said shield being of a kind to engage the edge of either plate of said electrode facing the other end of said lighting tube.

In an eighth aspect the present invention consists in a method of reducing sputter within a cold-cathode fluorescent lamp as described above wherein said electrode comprising a pair of electrodes provided at an end region of the lighting tube, each electrode positioned juxtaposed and with the planes of their plates parallel to each other wherein the planes of said plates are parallel to the elongate axis of said lighting tube, the method comprising engaging said shield to edge of at least one of said plates of said electrode facing the other end of said lighting tube, in a manner to least part cover at least those edges(s) of said electrodes facing the other end of said tube, In a ninth aspect the present invention consists in a method of reducing sputter within a cold-cathode fluorescent lamp as described above wherein said electrode comprising a pair of electrodes, each electrode positioned juxtaposed and with the planes of their plates parallel to each other and provided juxtaposed a region of said inner surface of the lighting tube, the method comprising the positioning of said shield over at least part of the surface(s) of that portion of at least one of said plates of said electrode proximal most to the ionisation region within said lighting tube.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

FIG. 5 is a sectional view through a prior art electrode illustrating the reflective movement of electrons relative thereto, FIG. 6 is a sectional view through a prior art electrode illustrating the impact of an electron on a transverse to the longitudinal direction surface of the electrode causing sputter, FIG. 7*a* is a perspective view of an electrode of the present invention with a cap provided thereon, FIG. 7*b* is a sectional view through 7*a,*

FIG. 8*a* is a perspective view of an alternative configuration of an electrode of the present invention with capping members provided thereon, FIG. 8*b* is a sectional view through FIG. 8*a,*

FIG. 9*b* is a sectional view through FIG. 9*a,*

DETAILED DESCRIPTION OF THE INVENTION

One embodiment of the present invention involves the use of an electron shield or cap made of electrically insulating and heat resistant material, such as ceramic material, quartz, or enamel which is attached to the end of at least one of the electrodes (or to only the cathode if the lamp is driven by DC current). Since alternating current is commonly applied to the CCFL used (usually with a frequency in the range of 30 kHz to 100 kHz), both electrodes can be considered a "cathode". The CCFL will normally consist of a sealed lighting tube 1 (preferably of 12 mm outside diameter or less) which has provided on at least part of its inwardly facing surface 2 a phosphorous material. Within the lighting tube (preferably of a cylindrical thin wall sectioned) will be provided at least one and preferably two electrodes as for example shown in FIG. 10. The electrodes 3 may themselves be substantially of a cylindrical shape as for example as shown in FIG. 7, or consist of parallel plates as for example shown in FIG. 8, or may be rod-shaped as for example shown in FIG. 9.

Sputtering is worst when the lamp starts. But it seems that sputtering will continue to occur (though to a lesser degree) after starting. While electron bombardment is the cause of sputtering, heating of the electrode may increase sputtering (the heat causes the atoms to become more energetic and to break the bond more easily).

Figure 12:
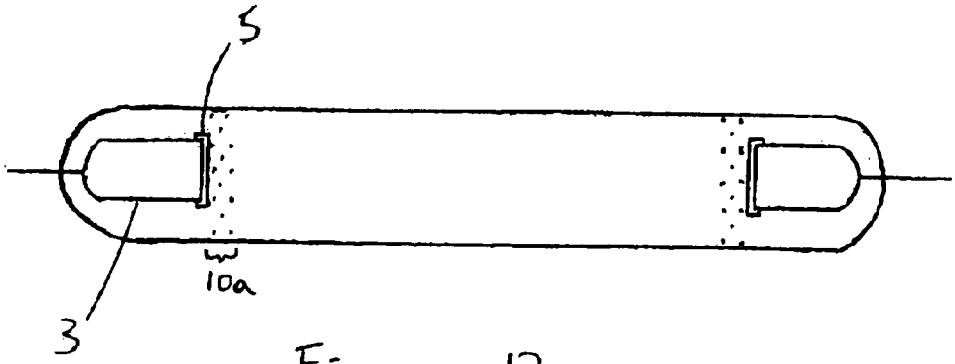
FIG. 12 is a view of a CCFL after 800 hours of use with the provision of a capping member.
Figure 14:
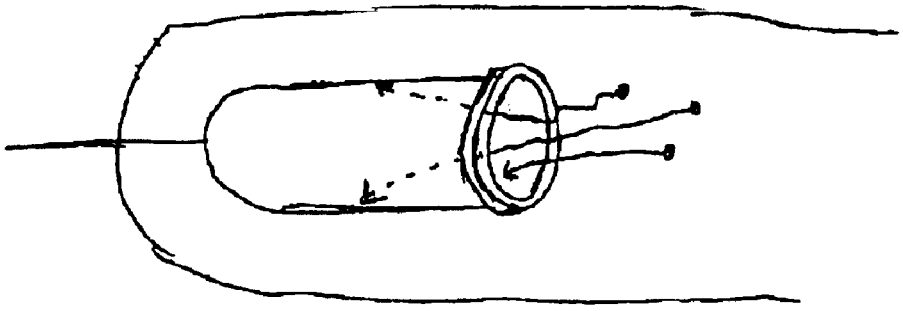
FIG. 14 is an isometric view of a capped electrode illustrating the movement of electrons relative thereto.

For a tubular electrode (FIG. 7), the rim of the electrode facing the ionization region has the worst sputtering because that is the main area of electron bombardment and has a small area. When an electron shield or electrically insulating cap covers the rim, the fact that the cap is insulating causes the electrons not to bombard the cap but to bombard the other conducting portions of the electrode, such as the inner wall of the tubular electrode as seen in FIG. 14. The area of bombardment in that case is bigger and so sputtering is less serious. FIG. 12 shows where the sputtered metal (from bombardment of the inner wall of the electrode) is deposited according to a preferred embodiment of the present invention utilising the cap. This figure shows that with the cap in place, sputtering does still occur but the depositing starts from the edge of the electrode. This indicates the sputtered metal came from the inner wall of the tubular electrode.

Figure 13:
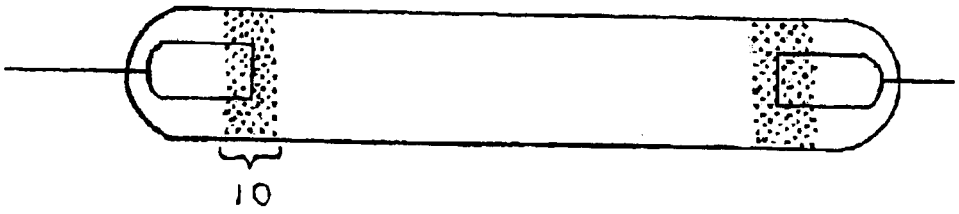
FIG. 13 is a view of a CCFL after 800 hours of use but without a capping member.

FIG. 13 according to the prior art with no cap, shows more serious sputtering and where the sputtered metal (from bombardment of the rim of the electrode) is deposited. Note the location of the region covered by the sputtered metal is different from that shown in FIG. 12 and is on both sides of the edge of the electrode.

We believe the cap alters the path of the electrons to avoid their striking the vulnerable small areas of the electrode which would otherwise result in serious sputtering.

When the electrode is in the form of a pair of parallel plates, the edges of the parallel plates facing the ionization region have the worst sputtering because the areas are small. For a rod shaped electrode, the rim at the end thereof is a sharp edge and has the worst sputtering. Generally, sputtering is relatively serious where there is a sharp point. The disc shaped end of a rod shaped electrode facing the ionization region would also likely have serious sputtering—relatively small area and possibly sharp points on a not completely smooth surface.

FIGS. 7 and 8 show the cap in situ. The cap is made from high heat resistant material and is preferably of a thickness sufficient to allow it to absorb a significant amount of heat. It is placed so as to face the main direction of movement of the electrons and to overlay the electrode at such regions otherwise significantly exposed to bombardment thereby. Where reference herein is made to the ionisation region, it is to be understood to be that region of the bulb or tube where the most significant proportion of ionisation will be induced by the electrodes. This region is normally the largest uninterrupted volume region and where, for example, a glass tube is used, the ionisation region is a substantial portion of the tube between its distal ends. Those regions which may be considered as non ionised regions are normally those regions of the tube or bulb which are behind the electrodes. In other words in one example, a non ionised region may be anywhere within the bulb or tube not intermediate of the two electrodes.

In particular the electrodes of a thin wall cylindrical nature as for example shown in FIG. 7 or of a thin wall planar nature as shown in FIG. 8 can lead to significant sputtering problems because of the small main area onto which electrons can be bombarded. In addition however solid rod electrodes as for example shown in FIGS. 9*a* and 9*b* can also benefit from the provision of a protective cap as its end surface is lateral (or at substantially right angle) to the main elongate direction of the glass tube hence thereby exposing such a surface to maximum impact forces by the electrons.

FIGS. 8*a* and 8*b* illustrate one form of a particular electrode arrangement for a CCFL. In this configuration a pair of substantially parallel (usually metal) plates 3 are provided to be positioned proximate to each other and positioned in one region adjacent the main ionisation region within the lighting enclosure. Both parallel plates 3 are supplied by energy from a common electrical source. The planes of the electrodes where the tube is of an elongate nature, are substantially parallel to the elongate direction of the tube. Although FIGS. 8*a* and 8*b* show both of the parallel plates being covered by caps, covering only one of the parallel plates 3 by a cap would still achieve reduced sputtering.

Figure 1:
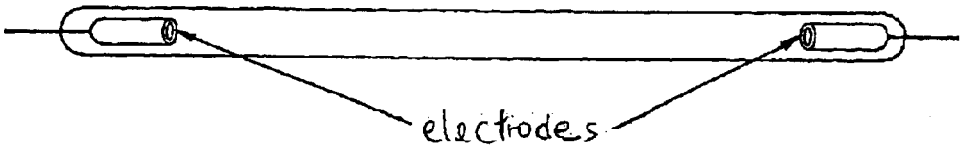
Figure 1 (prior Art)
FIG. 1 is a side view of a prior art CCFL.
Figure 2:
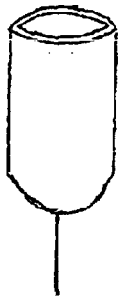
Figure 2 (prior Art)
FIG. 2 is a perspective view of a prior art electrode.
Figure 3:
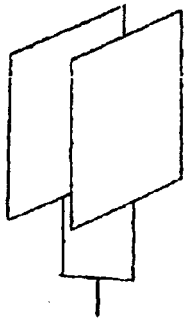
Figure 3 (prior Art)
FIG. 3 is a perspective view of an alternative prior art electrode.
Figure 4:
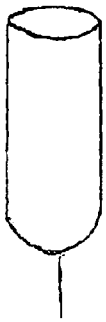
Figure 4 (prior Art)
FIG. 4 is a perspective view of yet a further alternative prior art electrode.
Figure 9A:
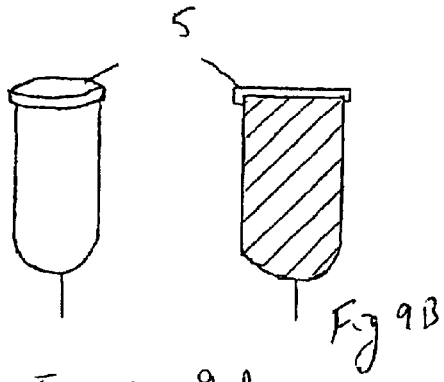
FIG. 9*a* is a perspective view of an alternative solid rod electrode with capping member provided.
Figure 9C:
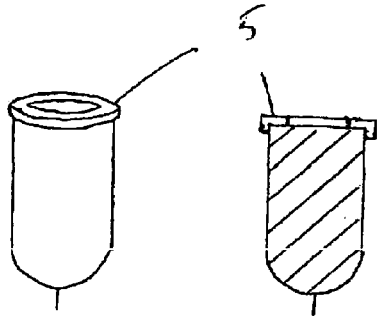
FIG. 9*c* is a view of a solid rod electrode with an alternative capping member provided thereon.
Figure 10:
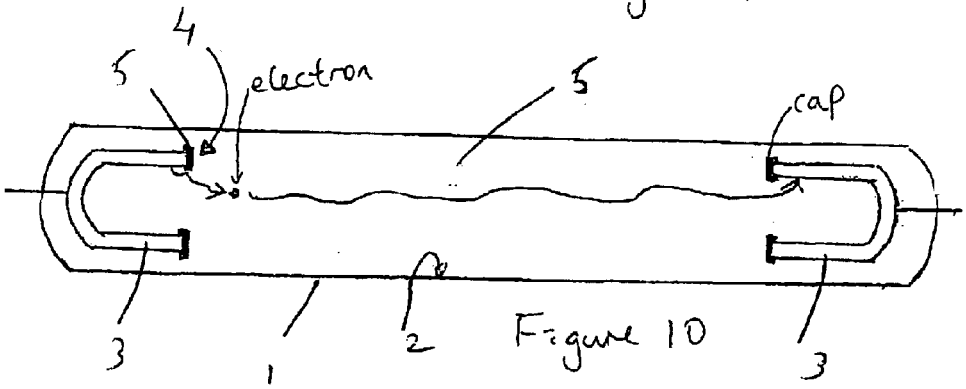
FIG. 10 is a sectional view of a CCFL with electrodes provided with capping members.
Figure 11:
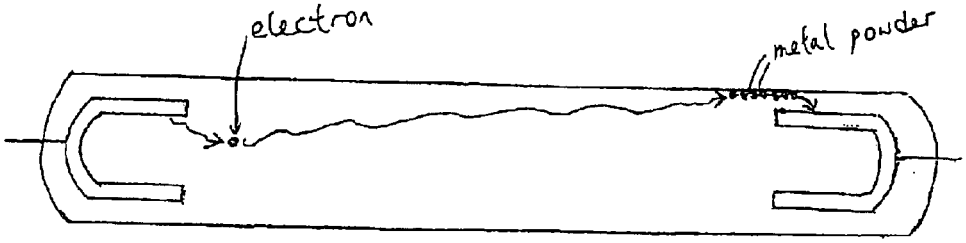
Figure 11 (prior Art)
FIG. 11 is a prior art sectional view through a CCFL showing that the deposition of metal powder on the interior surface of the glass tube can create a secondary conductive path for electrons.

FIGS. 9*a* and 9*b* show possible caps for the rod-shaped electrode. FIG. 9*c* illustrates a cap which consists of an annular ring of a sufficient size to overlay at least the perimeter surfaces of the rod-shaped electrode.

Whilst in the most preferred form the sealed lighting tube 1 is an elongate substantially cylindrical member, it is envisaged that as an alternative a bulb shaped like enclosure may also be provided. Hence whilst in the preferred form the cap is provided to that end of the electrode which is proximate most to the ionisation region within the tube, it is envisaged that in a more bulbous version, it will be that portion of the electrode which likewise is exposed to the ionisation region and where such an electrode is most likely to be subjected to high quantities of bombardment.

In the most preferred form the electrode is provided proximate more towards one end of the sealed lighting enclosure (whether it is a tube or a bulb); the main ionisation region is provided in a region of such an enclosure away from the location where the electrode is provided.

In the most preferred form the internal diameter of the glass tube is approximately 1 to 8 mm so the outside diameter of the tubular, cylindrical or rod-shaped electrode is approximately from 0.7 to 7 mm.

The cap may be removably attached to the electrode by simply placing the cap over the tip of the electrode. The cap can be taken off since the cap is not fired with the electrode and hence is a separate item that can be subsequently attached after the electrode has been created. Alternatively, the electrode and the cap may be fired so that the cap is permanently attached to the electrode. In this case, the electrode preferably has holes or recesses on its surface and the cap will as a result hold onto the electrode firmly because of the increased area of contact.

It will be appreciated by one skilled in the art that while the cap has been described for a number of different electrodes it is important only that portions of the electrode that are vulnerable to sputtering be covered. Accordingly any shape of cap or cover is possible. Particularly vulnerable areas include sharp edges or points. The portion of an electrode with a relatively small area facing the ionisation region is also vulnerable.

The photographs 12 and 13 show the effect of adding a cap. The lamps are shown after 800 hours use. FIG. 13 illustrates the electrode without a cap with a significantly less translucent region 10 (or sputtering region) whereas FIG. 12 illustrates the electrode 3 with a cap 5 and a less significant (smaller or more translucent) sputtering region 10*a*. Experiments show that with the use of a cap, the lifetime of a CCFL may be increased from 2 to 5 times. Furthermore, reduced or no sputtering means the absence of the secondary conducting path, therefore the illumination efficiency can be increased from 2 to 5%.

What is claimed is:

1. A cold-cathode fluorescent lamp, comprising:

a sealed lighting tube including an ionizable gas or vapour at least one electrode provided at an end of said tube, a coating on at least part of an inner surface of said tube wherein ionization of said gas or vapour on energization of said electrode causes said coating to provide visible radiation, and at least one electron or ion shield fitted to and covering at least a sputtering vulnerable portion of the tip of said electrode and capable of withstanding the operating temperature of said electrode.

2. A cold-cathode fluorescent lamp, as claimed in claim 1 wherein said shield comprises a cap provided over at least part of at least those surface(s) of said electrode facing the other end of said tube, and wherein said cap is made from a high heat resistant and electrically insulating material.

3. A cold-cathode fluorescent lamp as claimed in claim 1 wherein the lighting tube is of an outside diameter of less than 12 mm.

4. A cold-cathode fluorescent lamp as claimed in claim 1 wherein said shield is made of a material selected from any one of enamel, ceramic and quartz.

5. A cold-cathode fluorescent lamp as claimed in claim 1 wherein where the electrode is tube shaped and said shield is annular ring shaped with an inside diameter slightly smaller than the inside diameter of said tubular cylindrical electrode and an outside diameter slightly larger than the outside diameter of said cylindrical electrode.

6. A cold-cathode fluorescent lamp as claimed in claim 1 wherein where the electrode is rod shaped, said shield is disk shaped with an outside diameter slightly larger than the outside diameter of said cylindrical electrode.

7. A cold-cathode fluorescent lamp as claimed in claim 1 wherein where the electrode is rod shaped, said shield is annular ring shaped with an outside diameter slightly larger than the outside diameter of said cylindrical electrode and with a central opening there through.

8. A cold-cathode fluorescent lamp as claimed in claim 1 wherein two of said electrodes are provided, one at each end of said lighting tube.

9. A cold-cathode fluorescent lamp as claimed in claim 1 wherein said electrode is provided within said lighting tube rather than at the end.

10. A cold-cathode fluorescent lamp as claimed in claim 9 wherein said shield comprises a cap provided over at least part of the surface(s) of that portion of said electrode proximal most to the ionization region within said lighting tube and wherein said cap is made from a high heat resistant and electrically insulating material.

11. A cold-cathode fluorescent lamp as claimed in claim 10 wherein said at least part of the surface(s) of that portion of the electrode are those surface which are portions of low heat transfer.

12. A cold-cathode fluorescent lamp as claimed in claim 10 wherein said at least part of the surface(s) of that portion of the electrode are those surface which are facing the ionization region.

13. An electron shield for an electrode for a cold-cathode fluorescent lamp as claimed in claim 1 wherein said shield being of a kind to engage the tip of said electrode and capable of being positioned over at least part of at least those surface(s) of said electrode facing the other end of said tube.

14. A method of reducing sputter within a cold-cathode fluorescent lamp as claimed in claim 1 the method comprising engaging said shield to the tip of said electrode in a manner to at least part cover at least those surface(s) of said tip of said electrode facing the other end of said tube.

15. A method of reducing sputter in a cold-cathode fluorescent lamp as claimed in claim 1 wherein said electrode provided juxtaposed a region of said inner surface of the lighting tube the method comprising the positioning of said shield over at least part of the surface(s) of that portion of said electrode proximal most to the ionization region within said lighting tube.

16. A cold-cathode fluorescent lamp as claimed in claim 1 wherein said electrode comprising a pair of plate shaped electrodes provided at an end region of the lighting tube, each electrode positioned juxtaposed and with the planes of their plates parallel to each other wherein each said electrode of said pair includes a shield provided over at least part of at least those surface(s) of said electrode facing the other end of said tube.

17. A cold-cathode fluorescent lamp as claimed in claim 1 wherein said electrode comprising a pair of plate shaped electrodes provided within the lighting tube, each electrode positioned juxtaposed and with the planes of their plates parallel to each other and each positioned adjacent the ionization region within said lighting enclosure wherein at least part of the surface(s) of that portion of each said electrode proximal most to said ionization region are overlaid by said shield.

18. An electron shield for an electrode for a cold-cathode fluorescent lamp as claimed in claim 1 wherein said electrode comprising a pair of plate shaped electrodes provided at an end region of the lighting tube, each electrode positioned juxtaposed and with the planes of their plates parallel to each and wherein the planes are parallel to the elongate axis of said lighting tube, wherein said shield being of a kind to engage the edge of either plate of said electrode facing the other end of said lighting tube.

19. A method of reducing sputter within a cold-cathode fluorescent lamp as claimed in claim 1 wherein said electrode comprising a pair of electrodes provided at an end region of the lighting tube, each electrode positioned juxtaposed and with the planes of their plates parallel to each other wherein the planes of said plates are parallel to the elongate axis of said lighting tube, the method comprising engaging said shield to edge of at least one of said plates of said electrode facing the other end of said lighting tube, in a manner to at least part cover at least those edges(s) of said electrode facing the other end of said tube.

20. A method of reducing sputter within a cold-cathode fluorescent lamp as claimed in claim 1 wherein said electrode comprising a pair of electrodes, each electrode positioned juxtaposed and with the planes of their plates parallel to each other and provided juxtaposed a region of said inner surface of the lighting tube, the method comprising the positioning of said shield over at least part of the surface(s) of that portion of at least one of said plates of said electrode proximal most to the ionization region within said lighting tube.

* * * * *